US005775663A

United States Patent [19]

Fitzsimmons et al.

[11] Patent Number: 5,775,663

[45] Date of Patent: Jul. 7, 1998

[54] COPY STAND

[75] Inventors: William T. Fitzsimmons, South Portland, Me.; Steven E. Callahan, Sutton, Mass.

[73] Assignee: Microplas, Inc., Clinton, Mass.

[21] Appl. No.: 687,031

[22] Filed: Jul. 25, 1996

[51] Int. Cl.[6] ..... A47B 97/04

[52] U.S. Cl. ..... 248/450; 40/606

[58] Field of Search ..... 248/441.1, 450, 248/451, 454, 442.2; 40/606, 738, 764

[56] References Cited

U.S. PATENT DOCUMENTS

| | | | |
|---|---|---|---|
| 620,271 | 2/1899 | Brown | 248/453 |
| 686,417 | 11/1901 | Murray | 248/453 |
| 1,681,586 | 8/1928 | Kessler | 248/441.1 X |
| 1,719,503 | 7/1929 | Egan . | |
| 1,841,690 | 1/1932 | Weindel, Jr. | 248/453 |
| 1,847,138 | 3/1932 | Rosenberg | 248/453 |
| 3,272,183 | 9/1966 | Craighead et al. | 248/441.1 |
| 4,886,231 | 12/1989 | Doerksen | 248/444.1 X |
| 4,892,334 | 1/1990 | Sinclair | 248/441.1 X |
| 5,067,682 | 11/1991 | Figaro | 248/453 |
| 5,165,648 | 11/1992 | Quigley | 248/451 |
| 5,388,798 | 2/1995 | Glick | 248/459 |
| 5,413,305 | 5/1995 | Leeb | 248/460 |
| 5,505,421 | 4/1996 | Marthaler | 248/442.2 |

OTHER PUBLICATIONS

1994 Catalog showing copy stands on the market (8 pp).

*Primary Examiner*—Ramon O. Ramirez

*Attorney, Agent, or Firm*—James C. Wray; Meera P. Narasimhan

[57] ABSTRACT

A short, crescent-shaped copy stand engages the bottom edges of sheets and holds the sheets upright. The stand includes a back and an integrally formed, relatively small front block. The back has a downwardly and forwardly sloping concave sheet backing wall, a substantially horizontal top wall and a stepped front wall. A ledge or step extends forward from the lower edge of the sheet backing wall. The ledge slopes downward and inward from the its outer edges. The backing is concavely curved about a slightly rearward sloping axis, and the ledge concavely curves or slopes slightly upward and outward along the backing wall. The block is integrally formed with the backing wall and ledge at the approximate center of the backing wall. The block has a curved, generally vertical rearward wall that extends upward from a center of the ledge. The backing and the rearward facing wall of the block define sides of a slot for receiving centers of sheet bottom edges. The backing wall, the ledge and rearward facing wall of the block hold bottom edges of sheets curved about a rearward-tilted, generally vertical axis so that the sheets stand on their own. The copy stand is small, lightweight and easy to use. Sheets are securely held upright without slipping down and rest at a slight angle, thereby facilitating reading of text on the sheets.

19 Claims, 6 Drawing Sheets

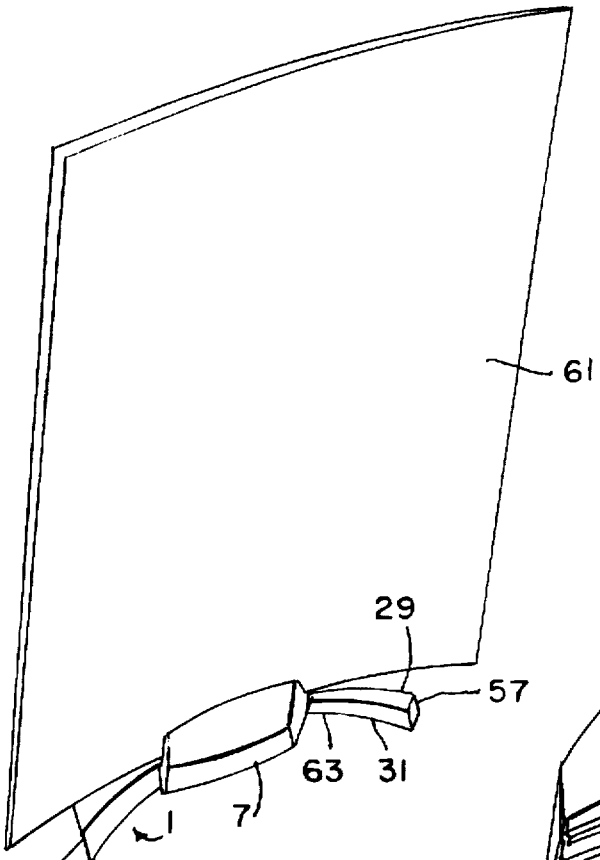
FIG. 6
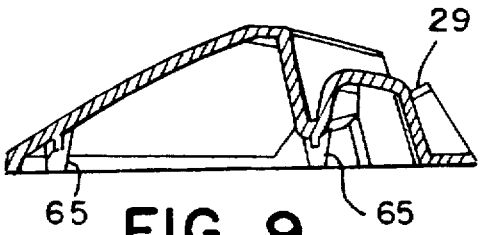
FIG. 9
FIG. 8
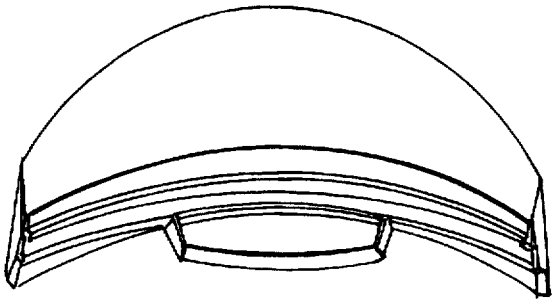
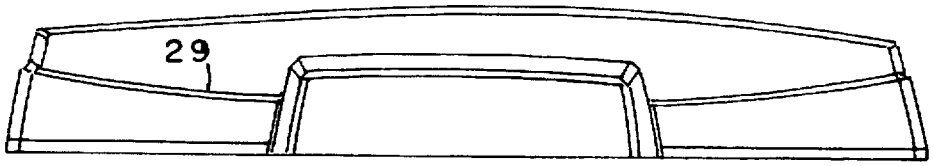
FIG. 7
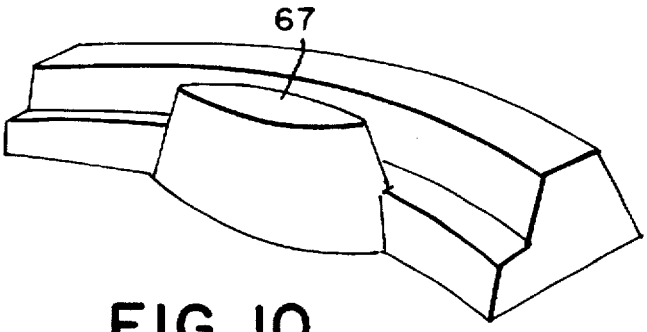
FIG. 10

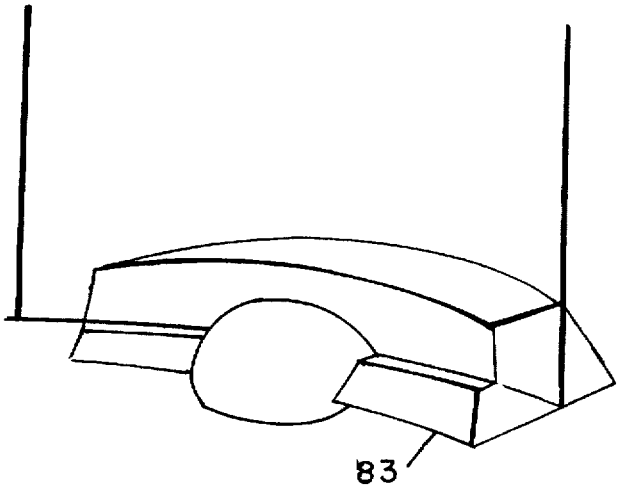
FIG. 16
FIG. 17
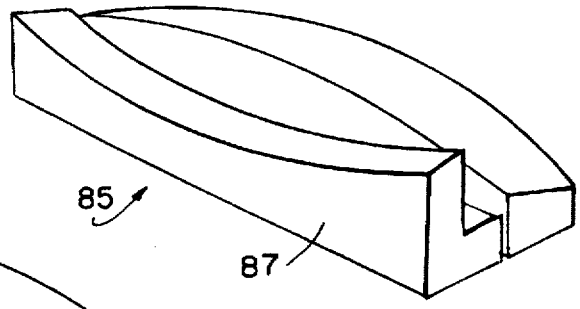
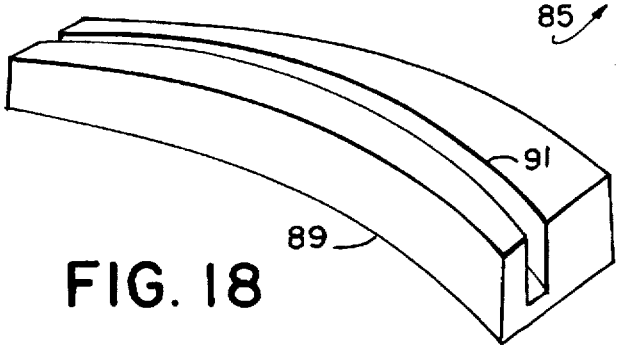
FIG. 18
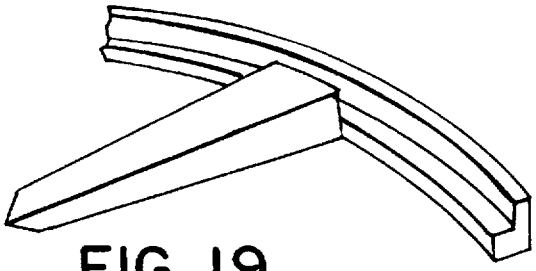
FIG. 19
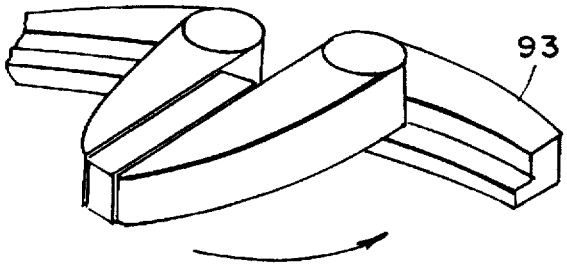
FIG. 20

COPY STAND

BACKGROUND OF THE INVENTION

The present invention relates to copyholders for supporting sheets of paper in upright positions.

Existing copyholders are generally classified into two categories: desktop stands and monitor-mounted holders. Desktop stands include a large plastic backing board, supports, such as legs, for holding the board upright and at an angle and a clip for securing pages to the board. The bottom of the board may have a lip on which bottom edges of the sheets rest. A transparent line guide extends widthwise across the board and over the pages for highlighting lines on the page and for further securing the pages to the board. Those stands are bulky, expensive, difficult to transport and take up much of the limited space available on retail shelves and on desktops. In addition, those stands are inefficient, as time must be dedicated to carefully release completed pages from the retaining clip. Needs exist for copyholders that are small, inexpensive and hold pages upright without the need of a clip.

Monitor-mounted holders have proven inadequate. Those holders generally include a movable arm having a mount at one end and a paper clamp at an opposite end. The mount connector may include mating pieces of Velcro or adhesive for mounting the arm on a top or a side of the monitor. Users often dislike gluing things to monitors. Alternatively, the mount includes an adjustable clamp for securing the arm to an edge of the desk or an edge of the monitor. Those holders are difficult to transport among workstations and, when Velcro or adhesive is used, are not readily relocatable. The inclusion of clips for securing top edges present the same expenses and inefficiencies encountered when using desktop stands. Needs exist for copyholders that are compatible with any workstation, easily transportable and inexpensive.

SUMMARY OF THE INVENTION

A simple, low-profile, inexpensive copy stand holds paper upright without the use of a clip. The copy stand easily fits in limited desk space or on computer monitors, holds almost any size sheet of paper, and provides for easy referencing of the text printed on the sheet. Importantly, the present invention is a universal desktop accessory that is inexpensive to manufacture, takes up minimal space on retail shelves and works well around any computer or typewriter.

The copy stand is preferably a one-piece molded structure that includes a back, a ledge and an integrally molded front block. The back has a flat bottom, a sloped front wall and a rear that curves downward from the upper edge of the front wall. A concave rearward sloped floor or ledge extends forward and upward from a bottom edge of the front wall. The front wall is concavely curved about a slightly rearward sloping axis. The front element is connected to the front of the floor. The front part has a short, convex rear wall which, along with the front wall and the floor, forms a slot for receiving bottom edges of the sheets. Preferably the front has a width that is substantially shorter than the width of the front wall and a height that is slightly less than the height of the front wall. The depth of the back is preferably greater than the depth of the front.

The back is crescent shaped and has a wide, rounded middle and narrow ends. The back preferably has a generally flat upper part and a spheroidal rear part. The rear part is substantially larger than the upper part.

The curved front wall of the back provides a sheet backing above the sheet bottom edge supporting a middle ledge. The sheet backing is curved about a slightly rearward sloping axis. The ledge extends from a lower edge of the sheet backing and curves or slopes slightly upward and outward from its center towards its side edges.

Preferably, the front is connected to the ledge near an approximate center of the front wall. The front is substantially smaller than the back. The front includes a curved rear wall that extends upward and slopes slightly outward away from the sheet backing. Preferably, the rear wall includes a lower part that is substantially vertical and an upper part having an upward and outward slope. Preferably, the rear facing wall does not extend above the sheet backing wall of the back portion.

A sheet-receiving slot is formed between the rear wall of the front and the sheet backing wall of the back. The slopes and curves of the front section and front wall of the back secure the sheets upright without using clips or other fasteners and without covering the print on the sheets.

The present invention can be made from a wide variety of materials and can take many different shapes and sizes. An important feature of the present invention is its curved front wall. By bending the sheets to conform to the slight curve of the front wall, and by holding outer edges of the sheets from dropping, multiple sheets are securely supported upright in the stand.

The copy stand is small, inexpensive, lightweight and easy to use and transport. Lower edges of one or more pages are placed in the slot defined by the front or block and the front wall of the back. To facilitate reading, the sheets are supported at an angle. That is accomplished in by the present invention in two ways: the sheet backing wall is given a slight angle and the ledge is curved to keep the bottom edges of the sheets from dropping down. Sheets are easily removed, rearranged and added. No clip is used to retain the sheets.

A small, portable stand apparatus supports one or more sheets. The apparatus includes a back and a front connected by a ledge. The back includes a curved front wall sloping from a top of the back. The front wall forms a sheet backing. A middle ledge has a curved floor which supports bottom edges of the sheets. The front includes a rear wall extending upward from the ledge. The sheet backing, the ledge and the rear wall define a slot for receiving the at least one sheet. The front, back and ledge are integrally molded to form a one-piece structure.

Preferably, the sheet backing slopes downward and forward from the top edge of the back. The ledge extends outward from a lower edge of the sheet backing and slopes slightly upward and outward from its center.

Preferably, the back includes a generally flat upper wall and a curved and sloped rear extending downward and outward from the upper wall. The width of the upper wall is smaller than a width of the rear. The bottom edge of the back is curved, and a curvature of the top edge is similar to a curvature of the bottom edge.

The front is connected to the intermediate ledge near a center region of the front wall. Preferably, the front has a width that is less than a width of the front wall. The rear wall of the front extends upward from a middle region of the ledge. The rear wall has curved upper and lower edges and has a height that is less than a height of the sheet backing of the front wall. Preferably, the rear wall has a substantially vertical lower part and an upwardly and outwardly sloped upper part.

Preferably, the back is generally crescent-shaped and has a wide, rounded middle and narrow, sloped ends.

These and further and other objects and features of the invention are apparent in the disclosure, which includes the above and ongoing written specification, with the claims and the drawings.

BRIEF DESCRIPTION OF THE DRAWINGS

FIG. 6 shows the copy stand of FIG. 1 supporting multiple sheets of paper upright.

FIGS. 7, 8 and 9 front elevation, top plan and side cross-sectional views of a current embodiment of the invention showing the sloping ledge, concave front wall and concave back wall, and feet-mounting lugs.

FIG. 10 is a schematic representation of a modification with a light for illuminating held papers.

FIG. 16 is an alternate design showing the holding of paper.

FIG. 17 is an alternate design showing an enlarged front block.

FIG. 18 is an alternate design showing a slot.

FIG. 19 is a design showing an extended front and shortened back.

FIG. 20 shows a device with an extended front and fold-out arms which form the back and ledge.

DETAILED DESCRIPTION OF THE PREFERRED EMBODIMENTS

Figure 1:
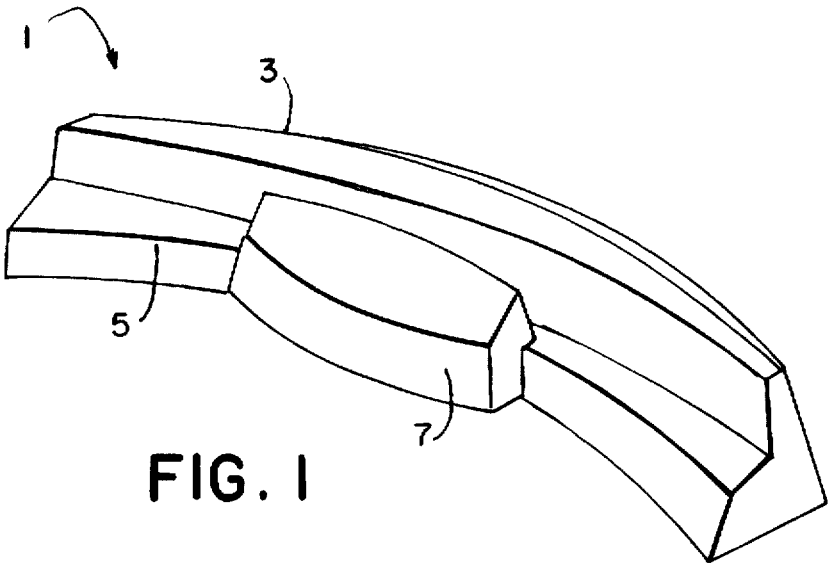
FIG. 1 is a perspective view of the copy stand.

As shown in the FIG. 1, the copy stand 1 includes a curved back 3 having a curved front wall 5 and a front retaining block 7 centrally connected to the ledge along the front wall 5 of the back 3. The stand 1 is substantially crescent-shaped, has a low profile and is easily transported.

Figure 2:
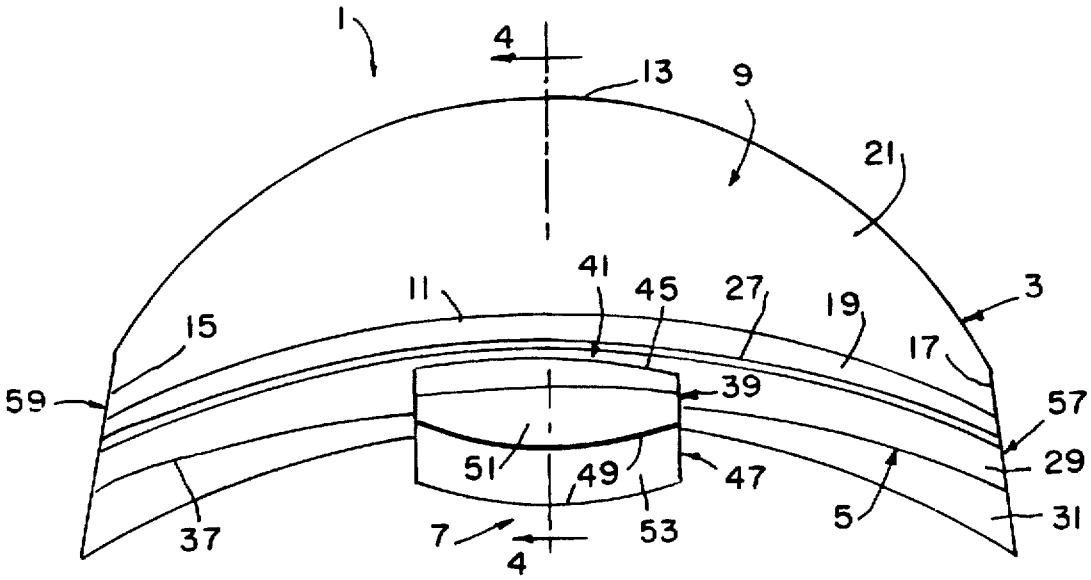
FIG. 2 is a top plan view of the copy stand.
Figure 3:
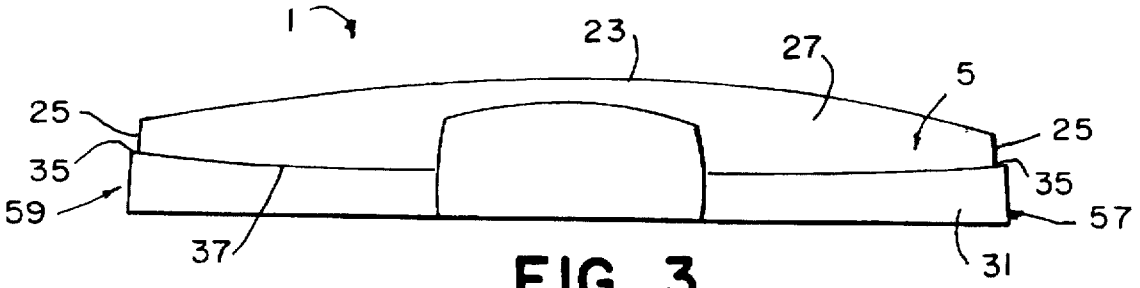
FIG. 3 is a front view of the copy stand shown in FIG. 2.
Figure 4:
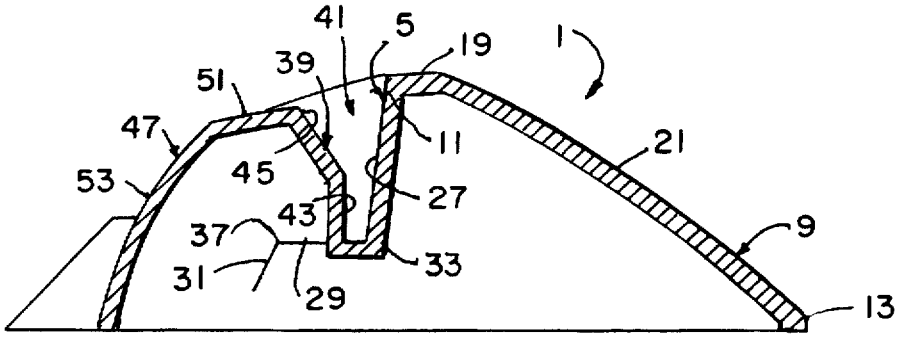
FIG. 4 is a side cross-sectional view of the copy stand shown in FIG. 2 taken along line A—A.
Figure 5:
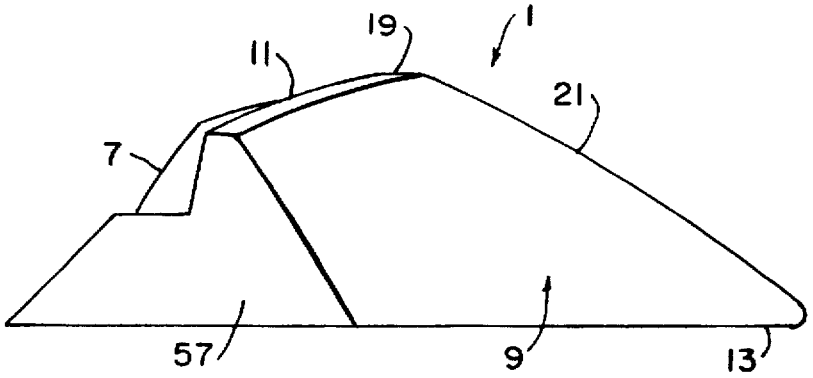
FIG. 5 is a rear perspective view of the copy stand shown in FIG. 2.

As shown in FIGS. 2–5, the back 3 of the copy stand 1 includes a curved rear slope 9 and a front wall 5. The top and the bottom 13 of the back 9 are concavely curved. The sides 15, 17 of the back 3 are substantially straight. As shown in FIGS. 1, 2 and 5, the back 3 preferably has a generally flat upper part 19 and a sloped lower part 21 extending downward and outward from the upper part 19. As shown in FIG. 2, the back 3 is wider in the rounded middle 23 and narrower at the flat ends 25.

As shown in FIGS. 2–4, the front wall 5 of the back 3 extends from the top 11 of the rear 9 and is concavely curved. Preferably, the front wall 5 includes a sheet backing 27. A floor 29 or middle ledge extends forward from the front wall. The sheet backing 27 is curved about a slightly rearward sloping axis. The slope of the sheet backing 27 is slight, but is pronounced enough to allow the sheets to lean slightly rearward when placed in the stand 1. The ledge 29 extends outward from a lower edge 33 of the sheet backing 27. As shown in FIG. 3, the ledge 29 slopes slightly upward as it extends outward toward its ends 35. That configuration, along with the overall curvature of the front wall 5 and the slant of the sheet backing 27, allows the sheets to stand securely upright without the need for a backing board or clip. The surface 31 slopes downward and outward from the forward edge 37 of the ledge 29.

As shown in FIGS. 1–4, a front retaining block 7 is connected to ledge 31 forward of the front wall 5 of the back 3. In preferred embodiment, the front block 7 is integrally molded with the surface 31 and the back 3, thereby forming a one-piece structure. The front block 7 is significantly smaller than the back 3.

As shown in FIGS. 2 and 4, the front block 7 preferably has a rear wall 39 that is connected to and extends upward from the ledge 29. A slot 41 for receiving bottom edges of sheets is defined by the rear wall 39 of the front block 7, and the ledge 29 and the sheet backing 27 of the front wall 5 of the back 3. The slot 41 is short, thereby making it easier to lead the sheets into position. To facilitate insertion and removal of sheets to and from the slot 41, the rear wall 39 of the front block 7 has a generally vertical, curved lower part 43 and an upwardly and outwardly sloped upper part 45. As shown in FIG. 4, the lower part 43 of the rear wall 39 preferably extends upward from the middle of the ledge 29.

As shown in FIGS. 2–4, the front block 7 preferably includes a second wall 47 extending downward and outward from the rear wall 39. The second wall 47 may have curved edges 49, as shown in FIGS. 2 and 3. As shown in FIGS. 2 and 4, the second wall 47 preferably has a slightly sloped top 51 and a more dramatically sloped front 53.

As shown in FIGS. 3 and 4, the upper edge 55 of the front wall 5 of the back 3 is higher than the rear wall 39 or second wall 47 of the front block 7.

As shown in FIGS. 1–4 and 5, the copy stand 1 has a pair of side walls 57, 59. The side walls 57, 59 are generally straight.

FIG. 6 shows a preferred embodiment of the present invention 1 securely holding several sheets 61 of paper. The stand 1 engages bottom edges 63 of sheets 61 and holds the edges 63 curved about a rearward-tilted, generally vertical axis. That allows the sheets 61 to stand on their own without the need for a backing or a clip. Bottom edges 63 of the sheets 61 rest on the ledge 29 and against the front wall 5 and lean slightly rearward against the curved sheet backing 27. The upward and outward slope of the ledge 29 prevents the bottom edges 63 from sliding down.

FIGS. 7, 8 and 9 shows a preferred embodiment in which the ledge 29 is curved and sloped upward and outward from a center and in which lugs 65 are formed on the bottom of the ledge and the bottom of the back to receive pressed-on rubber feet.

FIG. 10 shows a stand with a light 67.

Figure 11:
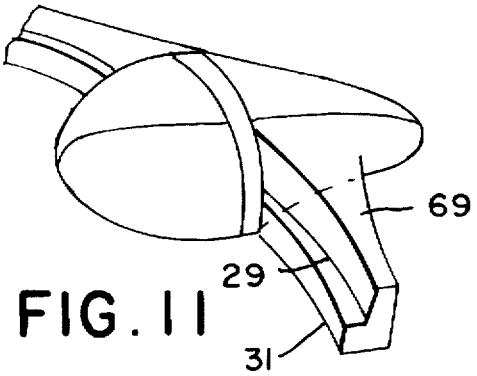
FIG. 11 shows a stylistic modification.

FIG. 11 shows an embodiment in which the back is formed with outward extending arms 69 which form the front face and the ledge 31 with the ledge 29.

Figure 13:
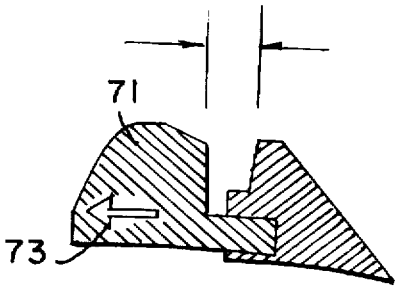
FIGS. 12 and 13 are perspective and cross-sectional schematic vies showing a movable front support which retracts automatically to adjust for a number of papers.
Figure 12:
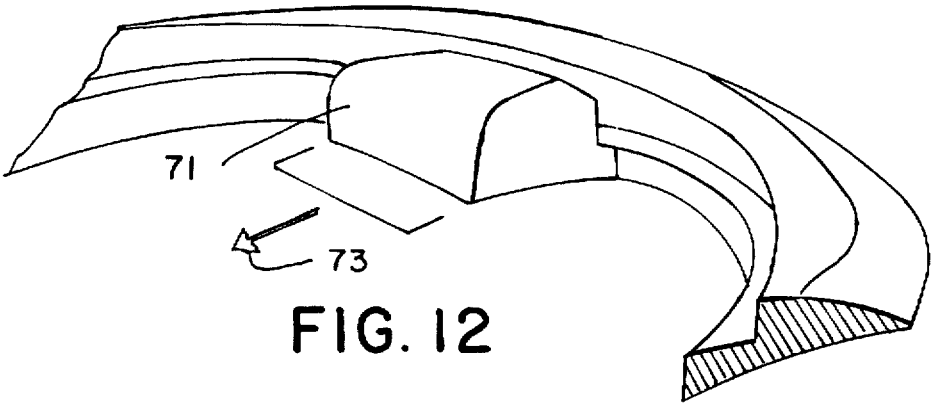

FIGS. 12 and 13 show a movable front 71 which is spring-loaded in the direction opposite to the arrows 73 to urge the front toward the back and toward the ledge.

Figure 14:
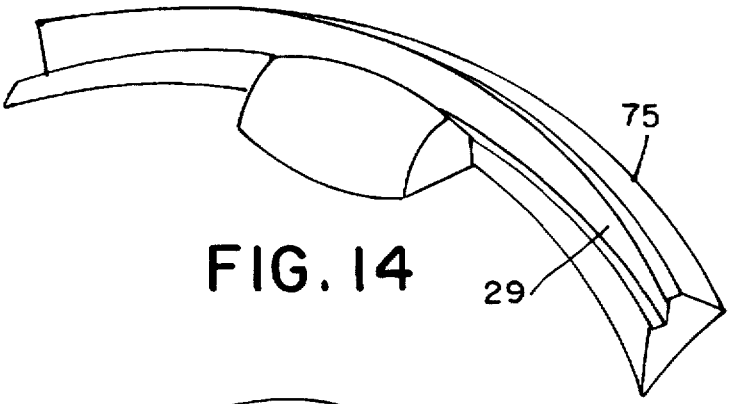
FIG. 14 shows an alternate shape.

FIG. 14 shows a thin elongated back 75 with the usual curved front face and ledge 29.

Figure 15:
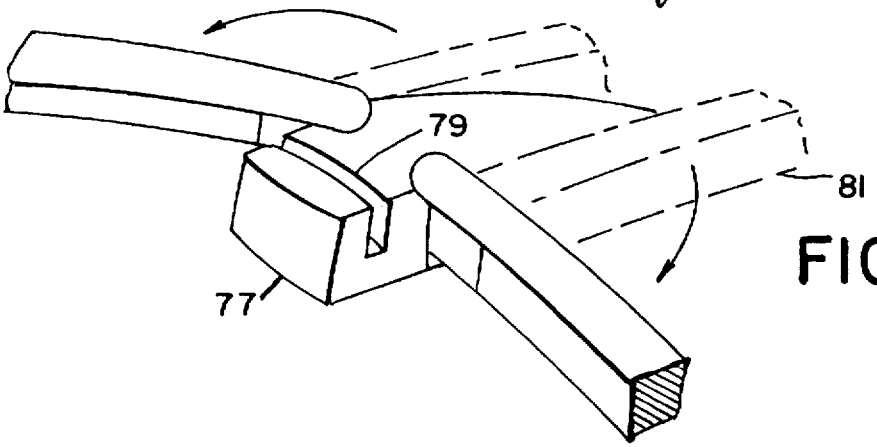
FIG. 15 shows a device with folding wings or arms.

FIG. 15 shows a device 77 in which the slot 79 is formed between the front and back, and in which arms 81 swing outward for additional support in use. The outward swinging arms may contain portions of the front wall 5 and the ledge 29.

FIG. 16 shows a modified form of a stand 83 in which a paper has been mounted.

FIG. 17 shows a modified form of a stand 85 in which the front 87 is extended.

FIG. 18 shows a stand 89 in which a slot 91 extends between the front and back and over the sloped ledge.

FIG. 19 shows an alternate form of the invention in which the front is extended while the back is shortened.

FIG. 20 shows a device similar to that shown in FIG. 19, in which the back and ledge are formed with fold-out arms 93 which are folded inward along the front when not in use.

Figure 21:
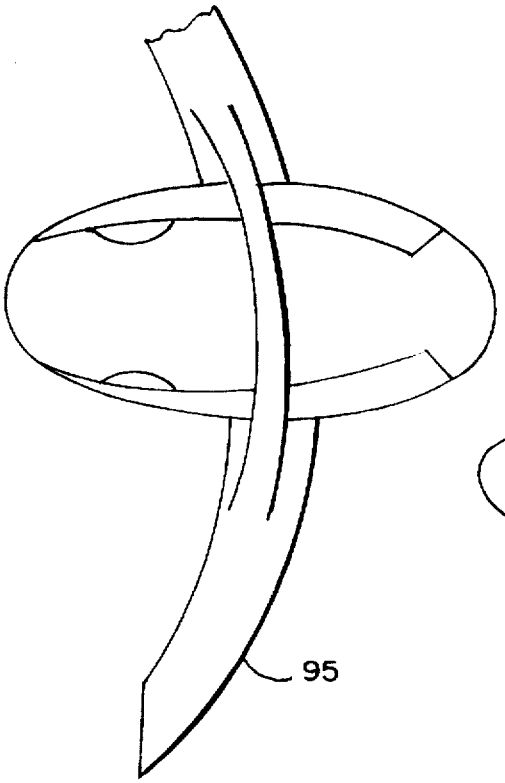
FIGS. 21 and 22 show a stand in which arms fold along the front and back in closed position.
Figure 22:
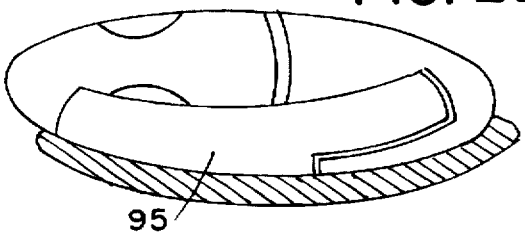
Figure 23:
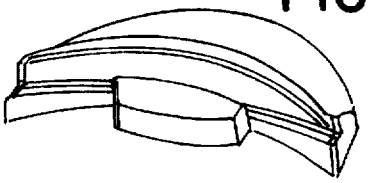
FIGS. 23–29 are respectively perspective, back, top front, right side, left side and bottom views of a preferred embodiment.
Figure 24:
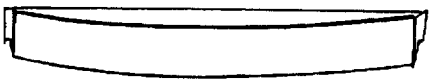
Figure 25:
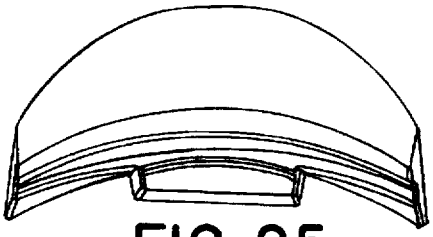
Figure 27:
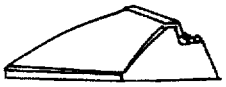
Figure 26:
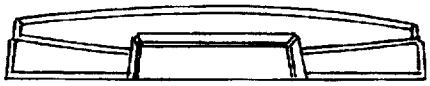
Figure 28:
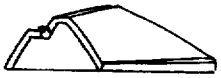

FIGS. 21 and 22 show a stand similar to that shown in FIG. 20, in which the arms 95 fold in along the front and back in the closed position.

Figure 29:
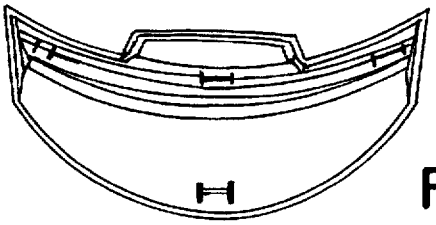

FIGS. 23–29 are respectively perspective, back, top front, right side, left side and bottom views of a preferred embodiment. The three I-beam-shaped lugs shown in FIG. 29 are capped by rubber feet.

The front can be a minimal 1/16" high without clips, which would obstruct the view. The front block is low enough to touch edges of the paper sheets and not to cover any printed material. The front can be a point or a rib, and the back could be plural ribs or contact points to hold the paper sheets curved. If vertical, the back can be short. If tilted, the back should be larger. The depth of the curve increases as the paper is tipped to strengthen the shape of the paper sheets. The back sticks out as little as possible, and the paper leans back as far as possible, consistent with creating a stable curvature of the paper while maintaining the written material legible.

The embodiments of the present invention shown in the figures can hold a single sheet or multiple sheets of paper upright.

The specific embodiments presented in no way limit the scope of the invention. Variations of the size and shape of the back and block are possible. In all embodiments, however, it is preferred that the sheet backing of the front wall is curved and has a rearward slope. The ledge of the front wall has a slight upward and outward slope, usually perpendicular to the front wall, for keeping bottom edges of the sheets from dropping down.

While the invention has been described with reference to specific embodiments, modifications and variations of the invention may be constructed without departing from the scope of the invention.

We claim:

1. A paper sheet stand apparatus, comprising a back, a front and an intermediate ledge, the back having a forward positioned short backing wall concavely curved around an upward and rearward sloping axis for allowing curved paper sheets to lean backward, the intermediate ledge having a paper sheet floor which curves upward and outward from a low central portion in front of a bottom of the backing wall for keeping outer edges of bottoms of paper sheets from dropping down, the front having a curved convex wall extending upward from a central portion of the floor for holding paper sheet bottom edges from sliding forward.

2. The apparatus of claim 1, wherein the floor slopes backward and downward.

3. The apparatus of claim 1, wherein the front is narrower than the back and intermediate ledge.

4. The apparatus of claim 1, wherein the back, the front and the intermediate ledge are molded in a single piece.

5. The apparatus of claim 4, wherein the back, the front and the intermediate ledge have a uniform wall thickness.

6. The apparatus of claim 5, wherein the back has a truncated crescent shape.

7. The apparatus of claim 6, wherein the back has a compound curved spheroidal rear wall.

8. The apparatus of claim 5, further comprising lugs extending downward from the back and the intermediate ledge and elastomeric feet secured on the lugs.

9. The apparatus of claim 1, wherein the back further has arms extending outward from the back.

10. The apparatus of claim 9, wherein the arms are pivoted to the back to swing outward to operational positions and inward along the back to stored positions.

11. The apparatus of claim 1, wherein the front is movable with respect to the back for holding different thicknesses of paper sheets.

12. The apparatus of claim 11, wherein the front is spring-loaded for movement toward the back for holding different thicknesses of paper sheets.

13. The apparatus of claim 1, further comprising a lamp in the front for illuminating paper sheets on the floor.

14. A stand apparatus for supporting sheets of paper, comprising a back and a front connected to the back, wherein the back further comprises a concave front wall sloping downward and forward from a top of the back, a middle ledge curving upward and outward along a bottom edge of the front wall of the back, the front having a convex rear wall extending upward from the ledge, and wherein the concave front wall, the ledge and the convex rear wall create a slot for receiving sheets of paper and holding them upright.

15. The apparatus of claim 14, wherein the back, the front and the ledge are integrally molded to form a one piece structure.

16. The apparatus of claim 14, wherein the ledge slopes rearward.

17. The apparatus of claim 14, wherein the front is connected to the ledge at a center of the ledge and the front wall.

18. The apparatus of claim 14, wherein the convex rear wall has a width that is less than a width of the front wall.

19. The apparatus of claim 14, wherein the back is generally crescent-shaped around the front wall and has a wide, rounded middle and narrow ends and flat, sloped end walls.

* * * * *